US005202609A

United States Patent [19]

Tomii et al.

[11] Patent Number: 5,202,609

[45] Date of Patent: Apr. 13, 1993

[54] FLAT CONFIGURATION IMAGE DISPLAY APPARATUS

[75] Inventors: Kaoru Tomii, Isehara; Hiroshi Miyama, Yokohama; Yoshikazu Kawauchi, Kawasaki, all of Japan

[73] Assignee: Matsushita Electric Industrial Co., Ltd., Osaka, Japan

[21] Appl. No.: 473,087

[22] Filed: Jan. 31, 1990

[30] Foreign Application Priority Data

Feb. 1, 1989 [JP] Japan ..... 1-22871

[51] Int. Cl.[5] ..... H01J 29/70; H01J 31/12; H01J 31/20

[52] U.S. Cl. ..... 315/366; 313/422; 313/425; 313/427; 313/497; 315/371

[58] Field of Search ..... 313/422, 425, 426, 427, 313/497; 315/366, 370, 371

[56] References Cited

U.S. PATENT DOCUMENTS

| | | | |
|---|---|---|---|
| 4,417,184 | 11/1983 | Takesako et al. | 315/366 |
| 4,449,148 | 5/1984 | Inohara et al. | 313/422 X |
| 4,542,322 | 9/1985 | Irie et al. | 313/422 X |
| 4,694,225 | 9/1987 | Tomii et al. | 313/422 X |
| 4,804,887 | 2/1989 | Miyama et al. | 313/422 X |
| 4,973,889 | 11/1990 | Tomii et al. | 315/366 X |

FOREIGN PATENT DOCUMENTS

| | | | |
|---|---|---|---|
| 55-33734 | 3/1980 | Japan . | |
| 59-134537 | 8/1984 | Japan . | |
| 60-115135 | 6/1985 | Japan . | |
| 60-131743 | 7/1985 | Japan . | |
| 0185345 | 9/1985 | Japan | 313/427 |

*Primary Examiner*—Donald J. Yusko
*Assistant Examiner*—Ashok Patel
*Attorney, Agent, or Firm*—Lowe, Price, LeBlanc & Becker

[57] ABSTRACT

In a flat configuration color display CRT in which one or more rows of electron beams are generated with the electron beams passing through respective apertures in successively disposed electrodes including horizontal deflection electrodes, apertures formed in an electrode positioned adjacent to the horizontal deflection electrodes have a central axis position displacement with respect to corresponding apertures of the horizontal deflection electrodes. A trajectory correction voltage which varies during each vertical scanning interval is applied to that adjacent electrode to execute dynamic adjustment of electron beam landing positions and thereby correct for an angular positioning error between a fluorescent layer pattern of the CRT and the electrode structure.

5 Claims, 8 Drawing Sheets

FLAT CONFIGURATION IMAGE DISPLAY APPARATUS

BACKGROUND OF THE INVENTION

1. Field of Applicable Technology

The present invention relates to a flat configuration image display apparatus for use in applications such as a color TV receiver, computer terminal, etc. In particular, the invention relates to an improved flat configuration color display cathode ray tube of the type which has a parallel array of line cathodes as an electron beam source.

2. Prior Art Technology

In the prior art, examples of a flat configuration cathode ray tube (hereinafter abbreviated to CRT) have been disclosed for example in Japanese Patent Laid-open Numbers 54-143063 and 55-33734, etc. With such a flat CRT, a set of mutually parallel thermionic line cathodes are each aligned extending horizontally (i.e. in the horizontal direction of a displayed picture) within an evacuated envelope, and are successively utilized during each scanning field to derive a corresponding horizontal row of electron beams, which are utilized in forming a set of horizontal lines of each picture field. Specifically, all of the electron beams of such a row are deflected horizontally in synchronism by a fixed amount to form one horizontal scanning line, then the beams are deflected vertically by a fixed amount and again deflected horizontally to form the next picture line, and so on. The horizontal and vertical deflection of the electron beams is executed by means of horizontal deflection electrodes and vertical deflection electrodes through which the electron beams are passed, before being accelerated to fall on a fluorescent layer formed on the inner surface of a transparent faceplate. The present invention is directed towards a color display type of flat CRT, in which the fluorescent layer consists of a pattern of fluorescent layer portions which emit respectively different colors of light, i.e. red, green and blue-emitting layer portions. This pattern will typically consist of successively alternating vertical stripes of red, green and blue-emitting fluorescent material.

A typical example of such a prior art flat configuration CRT will be described referring first to FIG. 1A. Numeral 1 denotes an array of mutually parallel thermionic line cathodes, extending horizontally and disposed at successive spacings in the vertical direction. (In the following description and in the appended claims, the designations "horizontal" and "vertical" are to be understood as referring to directions respectively parallel to the horizontal and vertical directions of a display picture produced by the CRT.) Each of the line cathodes 1 is formed of tungsten wire having a diameter that is in the range of 10 μm to several tens of μm, which is coated with a layer of a cathode oxide electron emission material to a thickness which is in the range of several μm to several tens of μm. A voltage is applied (from a source not shown in FIG. 1A) between the ends of each of these line cathodes to heat the cathode to a temperature in the range 600 to 800° C. A rear electrode 2 is disposed on the opposite side of the array of line cathodes 1 from the electron beam emission side, for use in successively selecting the line cathodes 1 during each vertical scanning interval and for directing the emitted electrons of a selected cathode in the beam-emission direction. The method of heating and biasing each of the line cathodes 1 is illustrated in FIGS. 2A and 2B. As shown in FIG. 2A, each of the line cathodes 1 is coupled at one end through a corresponding diode 21 to ground potential. A corresponding drive voltage $V_c$ is applied to the diode from the aforementioned source, with the waveform of this drive voltage being as shown in FIG. 2B. Normally, each of the line cathodes 1 is held at a positive bias voltage $E_k$, to thereby heat the line cathode to the requisite temperature by a current which passes through the diode 21. In this condition, emission of electrons is inhibited. However during a specific part of each vertical scanning interval in which that line cathode is utilized (for example during an interval in which 16 successive horizontal picture lines are generated by means of a row of electron beams derived from that line cathode) a negative bias voltage $E_{kp}$ is applied to the line cathode, thereby reverse-biasing the diode 1a to thereby interrupt the flow of heating current and also setting the line cathode to a uniform negative potential, thereby enabling electron emission therefrom. The intervals in which this negative bias is applied occur sequentially during each vertical scanning interval, for successive ones of the line cathodes. The back electrode 2 can be formed as a metal plate, or as a conducting layer that is formed on an interior surface of the evacuated envelope of the CRT (not shown in the drawing).

Numeral 3 denotes an electron beam forming electrode, for forming a plurality of electron beams 11 from electrons that are emitted from the line cathodes 1. The beam forming electrode 3 has horizontal rows of through-holes 3a formed therein for passage of the electron beams 11, with the rows of through-holes 3a being disposed respectively opposite the line cathodes 1. Successive rows of electron beams are thereby generated from the line cathodes during each vertical scanning interval The shape, dimensions, and numbers of the through-holes 3a are determined by the requisite number of electron beam spots and the amplitude of the electron beam current, etc. A set of vertical deflection electrodes 4 can consist for example of a set of electrically conducting regions 4a that are each formed on a surface of a corresponding electrically insulating substrate. The vertical deflection electrodes 4 are driven by scanning voltages to deflect the electron beams 11 vertically. Numeral 5 denotes a set of modulation electrodes having vertically elongated slits 17 formed therein through which respective ones of the electron beams 11 pass, for controlling the intensities of the electron beams 11 in accordance with respective voltage signals which are applied to the electrodes 5 in accordance with the image display contents.

A shield electrode 6 has vertically elongated apertures 18 formed therein, corresponding in position to the apertures 17 in the modulation electrodes 5, and serves to provide shielding between the electrodes which are disposed before and behind the shield electrode. Horizontal deflection is executed by two electrically separate comb-shaped horizontal deflection electrodes 7a, 7b, which are meshed such as to form vertically elongated apertures 20 which are respectively positioned in correspondence with the apertures 17, 18 of the modulation electrodes 5 and shield electrode 6, i.e through which each of the electron beams 11 passes as illustrated in FIG. 1A, to be deflected in the horizontal direction. The vertically extending "teeth" portions of each of these electrodes are mutually connected to receive deflection voltages, with these connections being indicated as bus leads 27a, 27b in FIG. 10. Numeral 8 denotes a set of acceleration electrodes, for accelerating the electron beams 11, and 9 denotes a transparent faceplate of the CRT (formed of a material such as glass). In general, the transparent faceplate 9 is part of the envelope of the CRT, and has a light emission layer 10, including a fluorescent layer 10*a* formed on the inner surface thereof and with a metal back layer 10*b* (e.g., a thin film of aluminum) formed over the fluorescent layer. A high voltage (e.g. 5 to 20 KV) is applied to the metal back layer, identical to a voltage which is applied to the acceleration electrodes 8. In the case of a color display CRT, the fluorescent layer 10*a* consists of a pattern of fluorescent layer portions, e.g. consisting of alternating red, green and blue-emitting stripes as mentioned above.

The position relationships between the aforementioned gaps and apertures through which the electron beams 11 pass are illustrated in the partial plan view of the prior art CRT of FIG. 1A shown in FIG. 1B. Respective central axes (i.e. each passing centrally through an aperture in a direction perpendicular to the fluorescent layer 10*a*) of a set of apertures 17, 18 and 20 (of the modulation electrodes 5, shield electrode 6 and the horizontal deflection electrodes 7*a*, 7*b*) lie in a common straight line. As viewed in plan, this line corresponds to the trajectory of an electron beam 11 when in the horizontally undeflected condition.

Such a prior art flat configuration color display CRT has the advantages of a simple configuration, high brightness, and high resolution, together with a thin overall shape. However it has the practical disadvantage that it requires an extremely high accuracy of mutual position alignment between the fluorescent layer 10*a* pattern and the horizontal deflection electrodes, so that assembly of the CRT is difficult and only a relatively low manufacturing yield is attainable. The reasons for this will be described referring to the frontal view of FIG. 3, in which the fluorescent layer 10*a* consists of a pattern of fluorescent layer stripes for red, green and blue emission (designated as R, G and B), alternatingly arranged and extending vertically, with the horizontal deflection electrodes 7*a*, 7*b* shown in broken-line outline. The most serious form of position deviation between the horizontal deflection electrodes and the fluorescent layer stripe pattern is that shown in the drawing, with the horizontal deflection electrodes being slightly rotated (from a correct position) about a central point thereof with respect to the fluorescent layer stripes. With such a condition, accurate color rendition of a display picture becomes impossible. Specifically, assuming for example that a specific horizontal deflection condition (e.g. with no horizontal deflection being produced, so that each electron beam passes through the center of a corresponding one of the gaps 20 in the horizontal deflection electrodes) is being applied to the electron beams 11 when an uppermost horizontal picture line is being generated, and that an electron beam is falling on a specific fluorescent layer color stripe in that condition, it will be apparent that for an identical horizontal deflection condition when a horizontal picture line is being generated near the bottom of the display, an electron beam which vertically corresponds to the aforementioned electron beam will not fall upon the aforementioned specific fluorescent layer color stripe. Thus, correct display of colors of an image in accordance with signals applied to the modulation electrodes will not be possible. This condition cannot be corrected by static adjustment of respective fixed voltage levels that are applied to the electrodes.

This is a serious practical problem, since such a rotational position deviation between the electrode assembly and the fluorescent layer stripe pattern of the CRT can very easily occur at the time of assembly of the electrodes within the outer envelope, resulting in the manufacturing yield of such a flat configuration CRT being reduced.

SUMMARY OF THE INVENTION

It is an objective of the present invention to overcome the disadvantages of the prior art set out above, by providing a flat configuration CRT whereby an angular positioning error between the electrode structure and the fluorescent layer pattern of such a CRT can be eliminated by applying a varying correction voltage during each vertical scanning interval to adjust the respective beam landing positions of the electron beams.

To achieve the above, objective, a flat configuration CRT according to the present invention comprises an electron beam source for producing at least one row of electron beams, a fluorescent material layer formed in a predetermined pattern on a surface of a transparent plate, and a plurality of electrode means successively disposed between the electron beam source and the fluorescent material layer, the plurality of electrode means comprising horizontal deflection electrode means defining a plurality of vertically extending apertures for passing respective ones of the electron beams, and is characterized in that each of the apertures of the horizontal deflection electrode means has a central axis which is horizontally displaced by a predetermined distance from a central axis of a corresponding aperture of another one of the plurality of electrode means, and is further characterized in comprising trajectory correction voltage generating means for supplying to the other electrode means a trajectory correction voltage which varies in amplitude during each of successive vertical scanning intervals such as to produce correction of respective beam landing positions of the electron beams.

Specifically, in the case of a flat configuration CRT having a shield electrode disposed immediately adjacent to the horizontal deflection electrodes, each of the apertures of the shield electrode (through which electron beams pass) can have a central axis position which is displaced slightly from a common central axis of corresponding apertures in the horizontal deflection electrodes and other electrodes through which the electron beams are passed. In this case, the trajectory correction voltage is applied to the shield electrode, superimposed upon a fixed DC voltage that is supplied to the shield electrode of a prior art CRT of this type.

The present invention thereby enables dynamic correction of the beam landing positions of the electron beams of such a CRT during each vertical scanning interval in a very simple manner, without the need to provide additional electrodes for executing this correction.

BRIEF DESCRIPTION OF THE DRAWINGS

FIG. 4 is a plan cross-sectional view, and FIG. 5 is a partial expanded view of FIG. 4;

DESCRIPTION OF PREFERRED EMBODIMENTS

Embodiments of the present invention will be described in the following, referring first to FIG. 4.

A first embodiment of the present invention will first be described. FIGS. 4 and 5 show this first embodiment of a flat configuration image display apparatus according to the present invention. FIG. 4 is a cross-sectional plan view, and FIG. 5 is a partial expanded view of FIG. 4.

Figure 1A:
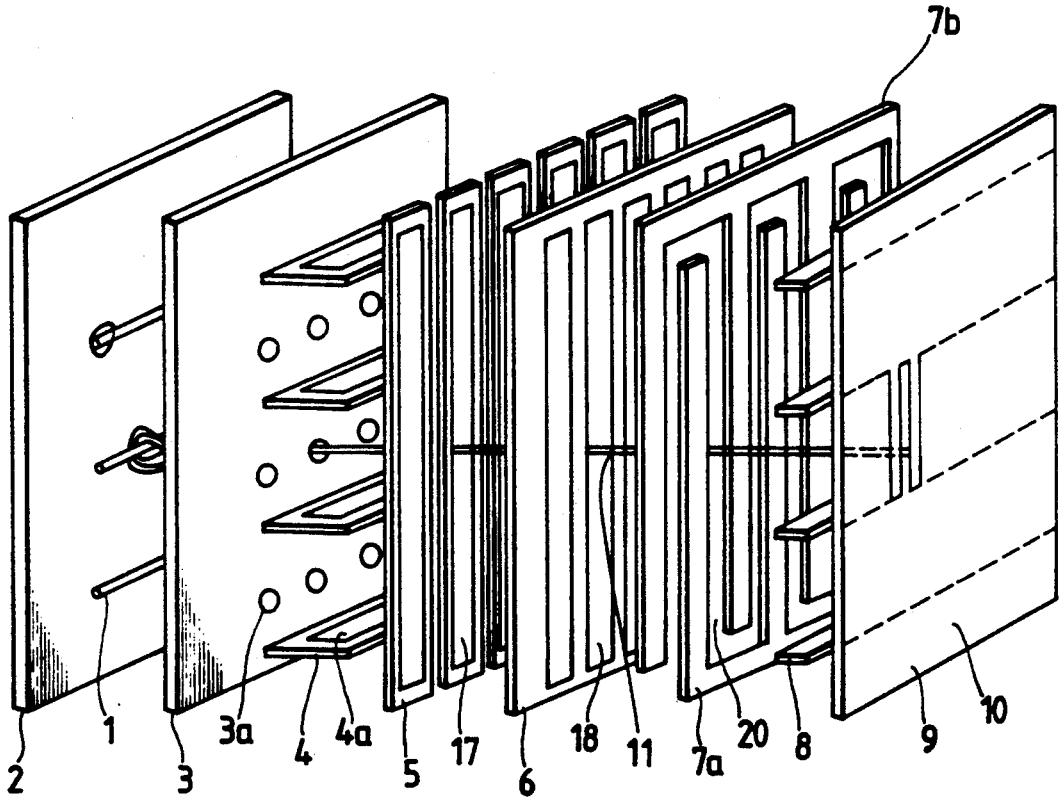
FIG. 1A PRIOR ART
FIG. 1A is an oblique view of a prior art flat configuration CRT.
Figure 1B:
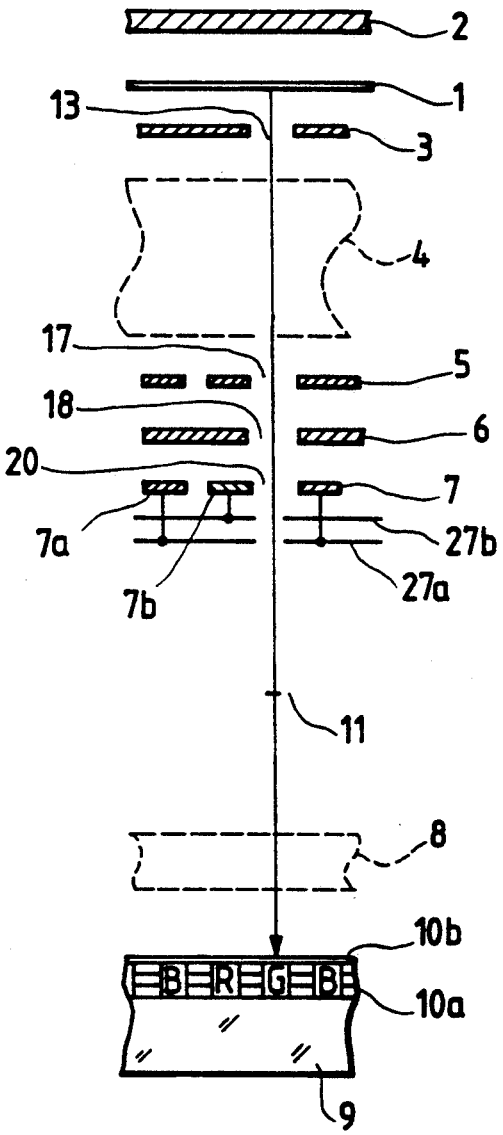
FIG. 1B PRIOR ART
FIG. 1B is a partial plan view of the CRT of FIG. 1A.
Figure 2A:
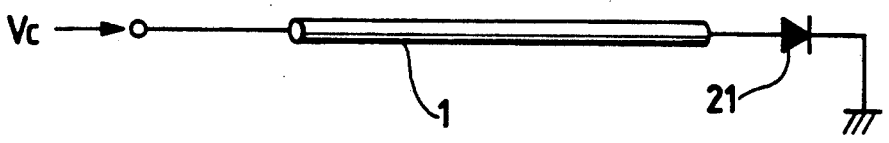
FIG. 2A PRIOR ART
FIG. 2A illustrates how heating and biasing drive voltages are applied to each of the line cathodes of the CRT of FIG. 1A.
Figure 2B:
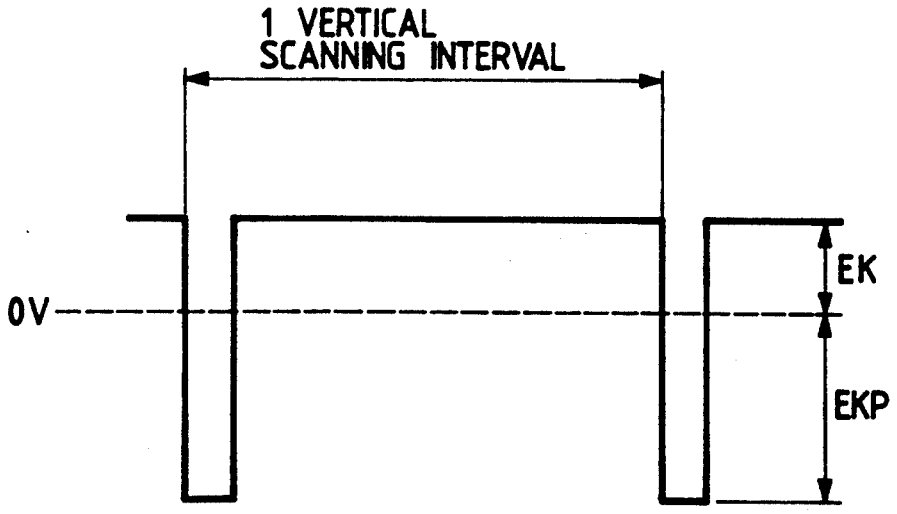
FIG. 2B PRIOR ART
FIG. 2B is a corresponding waveform diagram.
Figure 3:
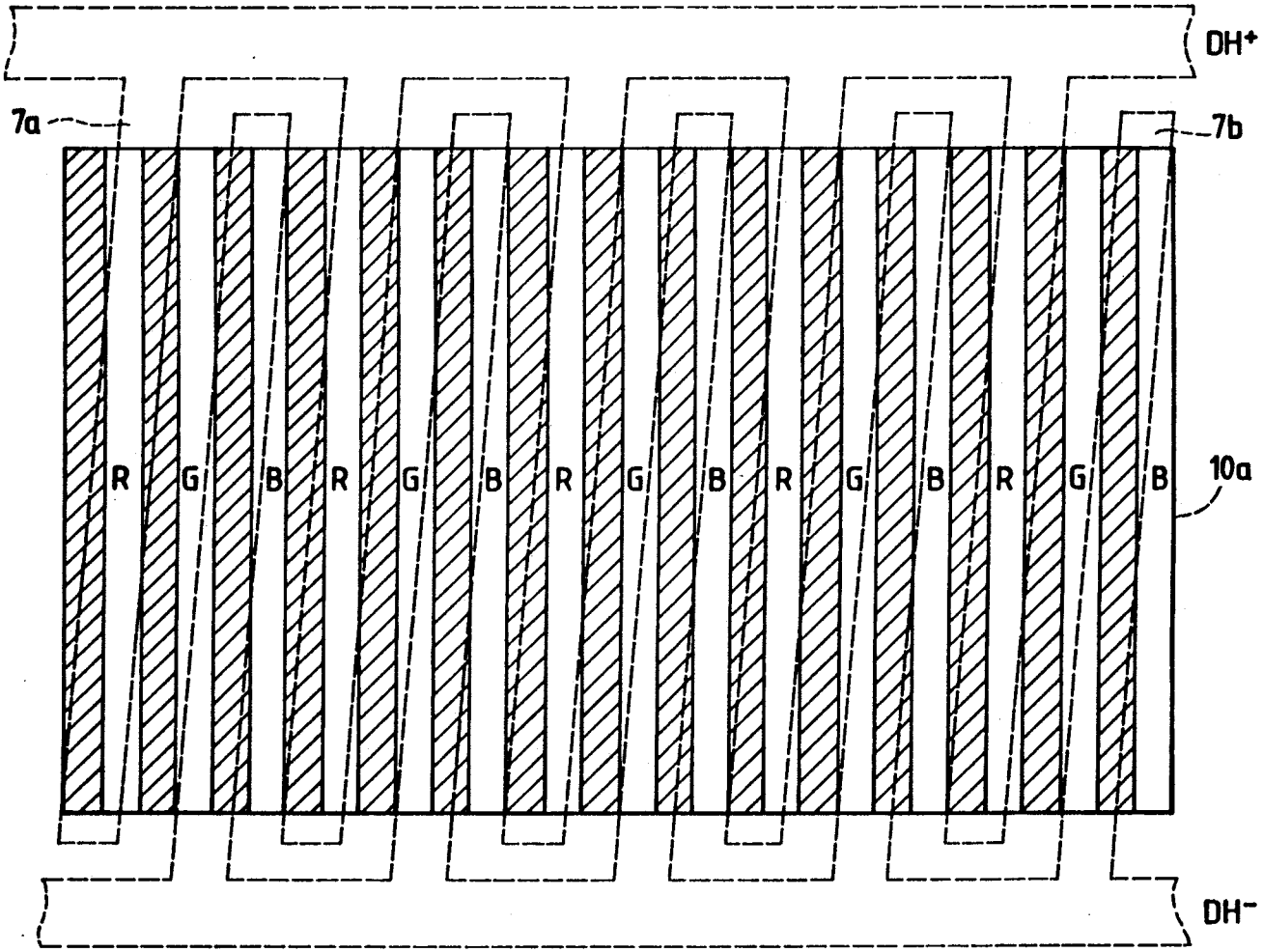
FIG. 3 PRIOR ART
FIG. 3 is a diagram for describing a rotational positioning error between a fluorescent layer pattern and horizontal deflection electrodes of a flat configuration CRT.
Figure 4:
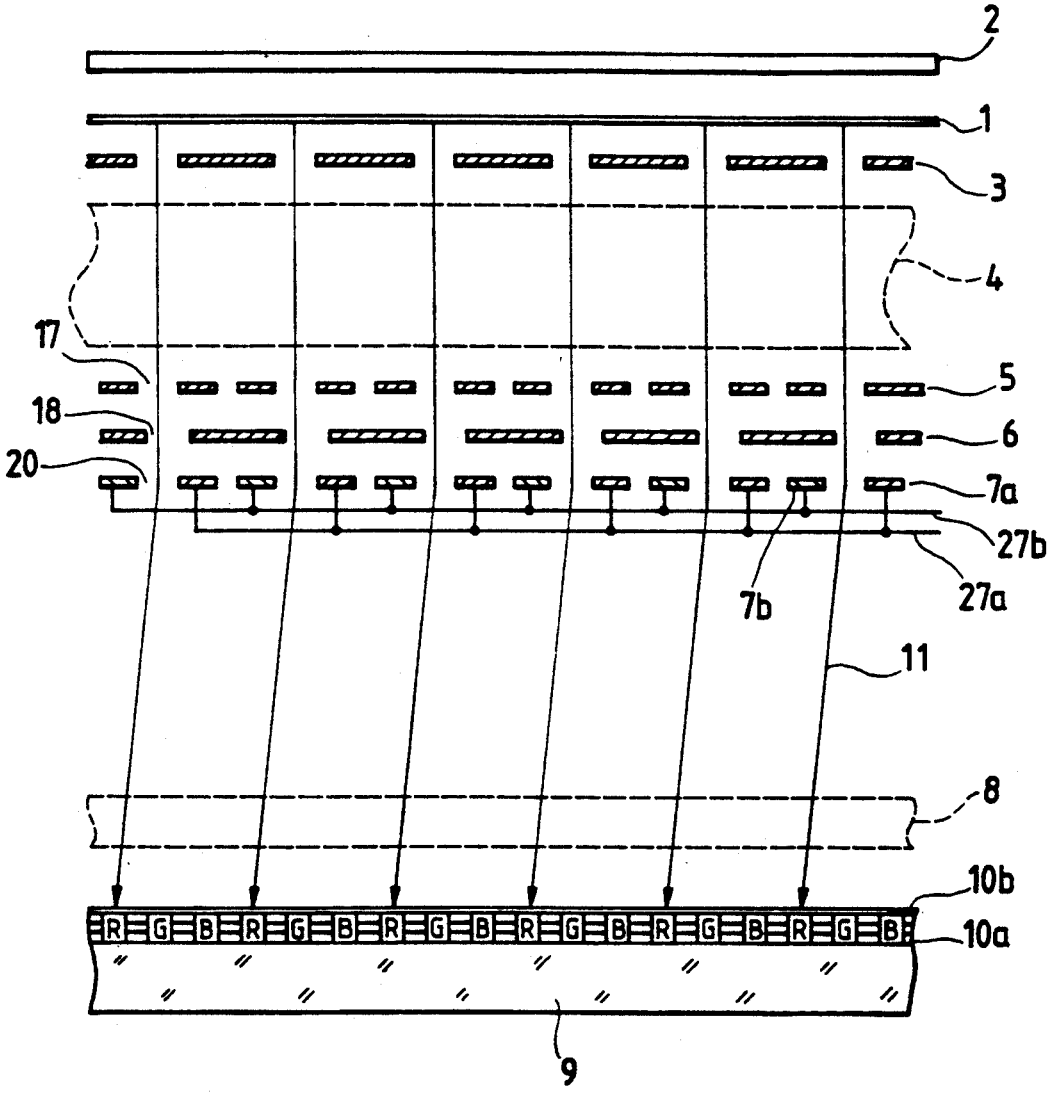
FIGS. 4 and 5 show a first embodiment of a flat configuration CRT according to the present invention, where
Figure 5:
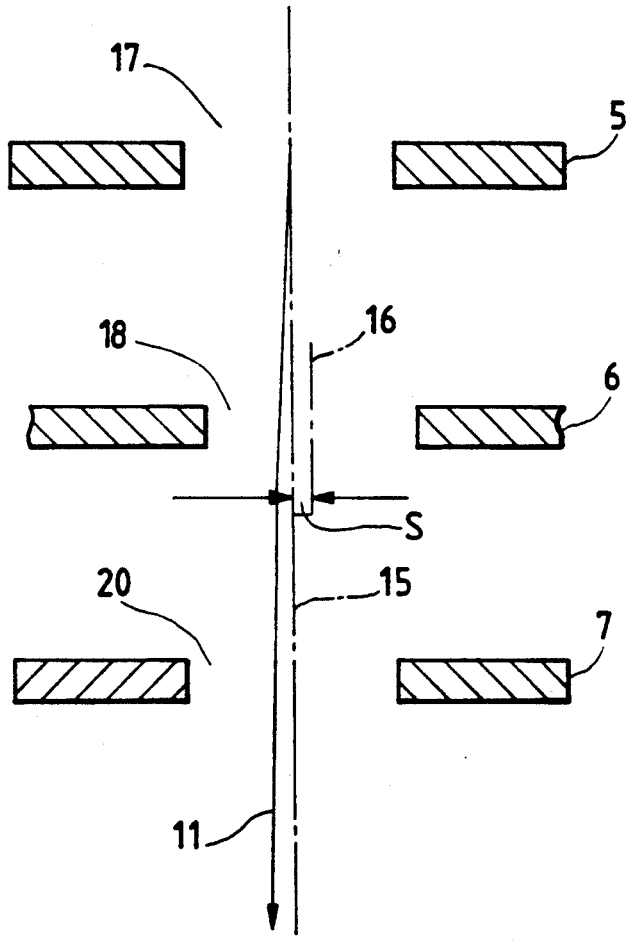

As shown in FIG. 4, as for the prior art example described above, the embodiment includes line cathodes 1, back electrode 2, an electron beam extraction electrode 3, vertical deflection electrodes 4, modulation electrodes 5, a shield electrode 6, horizontal deflection electrodes 7a,7b, acceleration electrodes 8, a transparent substrate 9, and a light-emission layer 10 consisting of a fluorescent layer 10a and a metal back layer 10b, with the fluorescent layer 10a being formed in a predetermined pattern of different color-emission layer portions which will be assumed to be of the form shown in FIG. 3.

This embodiment differs from the prior art example described above in that each of the vertically extending apertures 18 formed in the shield electrode 6 (positioned at the opposite side of the horizontal deflection electrodes 7a, 7b from the light-emitting layer 10) has the central axis thereof separated by a predetermined distance (in the horizontal direction) from the common central axis of the corresponding vertically extending aperture 20 formed by the horizontal deflection electrodes 7a, 7b and of the corresponding ones of the apertures 13, 17 of electrodes 3, 5.

The trajectories of the electron beams 11 are thereby altered as a result of the position displacement of the through-hole central axes of the shield electrode 6, as illustrated in FIG. 5. In FIG. 5, the chain line 15 represents the common central axis of the apertures 17, 20 of the modulation electrodes 5 and the horizontal deflection electrodes 7a, 7b. The chain line 16 indicates the central axis of the corresponding aperture 18 of the shield electrode 6. As shown, there is a fixed amount of horizontal separation S between the central axis lines 15, 16. As a result, with respective voltage values being applied to the modulation electrodes 5, shield electrode 6 and horizontal deflection electrodes 7a, 7b at a specific point in time and assuming for example that the amount of horizontal deflection that is being applied by the horizontal deflection electrodes 7a, 7b is zero at that time, the trajectory of the corresponding one of the electron beams 11 will be altered from the central line 15 to a line that is at an angle to that central line, as shown. A corresponding change in the beam landing positions of the electron beams will thereby result. The amount of this deflection is determined by the magnitude of the separation amount S and by the level of voltage applied to the shield electrode 6, i.e. the amount of this electron beam deflection can be varied by varying the voltage applied to the shield electrode 6.

Thus, by applying an appropriately varying trajectory correction voltage to the shield electrode 6 during each vertical scanning interval, each of the electron beams 11 can be deflected such that the position of incidence of each beam on the light-emitting layer 10 and the angle of incidence of each beam (i.e. with respect to the aforementioned common central axis line 15) can be dynamically altered during the vertical scanning interval, such as to correct for a rotational positioning error such as that illustrated in FIG. 3.

For example it will be assumed that the beam acceleration voltage is 10 KV, the modulation electrode voltage is 40 V, the shield electrode voltage is 200 V, the horizontal deflection electrode voltage is 150 V (for the zero horizontal deflection condition), with all of these being DC values. If the voltage applied to the shield electrode 6 is now changed slightly, then a substantial change will occur in the respective trajectories of the electron beams 11, so that corresponding changes in the respective beam landing positions on the fluorescent layer 10a will occur. A beam landing position change of 10 μm or more can be achieved in response to a change of several volts in the potential of the shield electrode 6. This is achieved with virtually no change in the size of the beam spot that is formed on the light-emitting layer 10, or the beam current.

As a result, in the case of the condition shown in FIG. 3, in which the pattern of the fluorescent layer 10a and the horizontal deflection electrodes 7a, 7b are mutually displaced by rotation about a central axis, it becomes possible to arrange that for a specific horizontal deflection condition (e.g. the zero horizontal deflection condition) the landing positions of respective the electron beams will be on identical predetermined color portions of the pattern of the light-emitting layer 10 from the top to the bottom of the display screen, by suitably changing the voltage which is applied in common to the shield electrode 6 during each vertical scanning interval, i.e. by dynamic adjustment of the shield voltage. Color deviations between the upper and lower regions of the display picture produced by the CRT can thereby be completely eliminated.

Figure 6A:
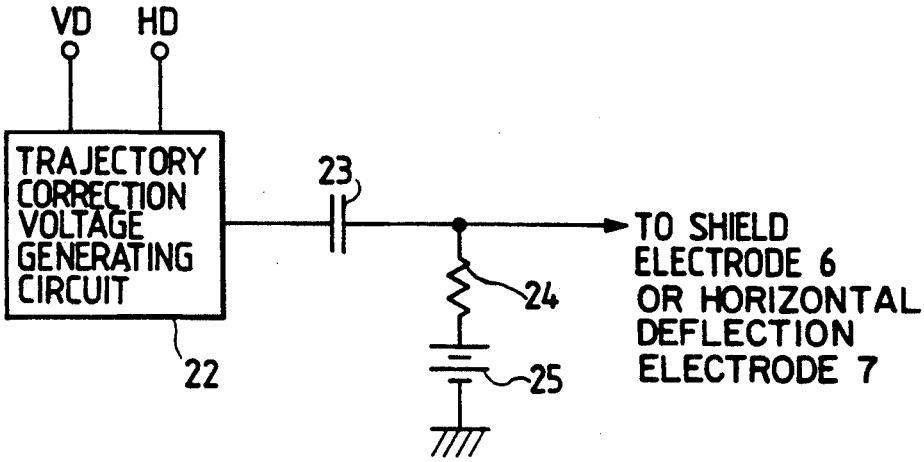
FIG. 6A shows a circuit for supplying a trajectory correction voltage to a shield electrode of the embodiment of FIG. 4.
Figure 6B:
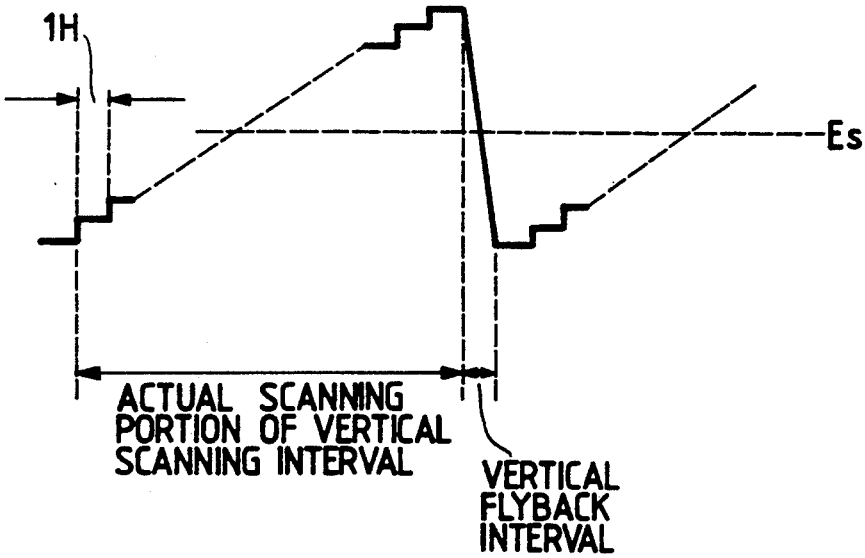
FIG. 6B is a corresponding waveform diagram.

FIG. 6A is a general block diagram of a circuit for supplying such a trajectory correction voltage to the shield electrode 6, superimposed on a fixed DC voltage level, while FIG. 6B is a corresponding waveform diagram. Here a DC voltage $E_s$ produced from a voltage source 25 is supplied via a resistor 24 to the shield electrode 6, while a trajectory correction voltage generating circuit 22 generates a trajectory correction voltage signal that is transferred through a capacitor 23 to be superimposed on the DC voltage $E_s$. The operation of the trajectory correction voltage generating circuit 22 is synchronized with horizontal and vertical synchronizing signals HD and VD that are derived from a video signal which modulates the CRT. The trajectory correction voltage signal periodically varies, with a period which corresponds to the vertical scanning interval of synchronizing signal VD, and in this example consists of a staircase-waveform signal which increases by a fixed positive amount at the start of each horizontal scanning interval (1H), i.e. in synchronism with the horizontal synchronizing signal HD, reaching a maximum positive value at the end of each vertical scanning interval. A minimum amount of beam landing position shift is produced when the trajectory correction voltage signal level is a minimum (i.e. at the start of each vertical scanning interval) and the amount of shift successively increases until the end of each vertical scanning interval. It will thus be apparent that by suitably selecting the amplitude of the trajectory correction voltage signal amplitude variation in each vertical scanning interval, it becomes possible to accurately compensate for a rotational positioning error between the electrode structure and the (color stripe) fluorescent layer pattern which is of the form shown in FIG. 3.

Figure 7:
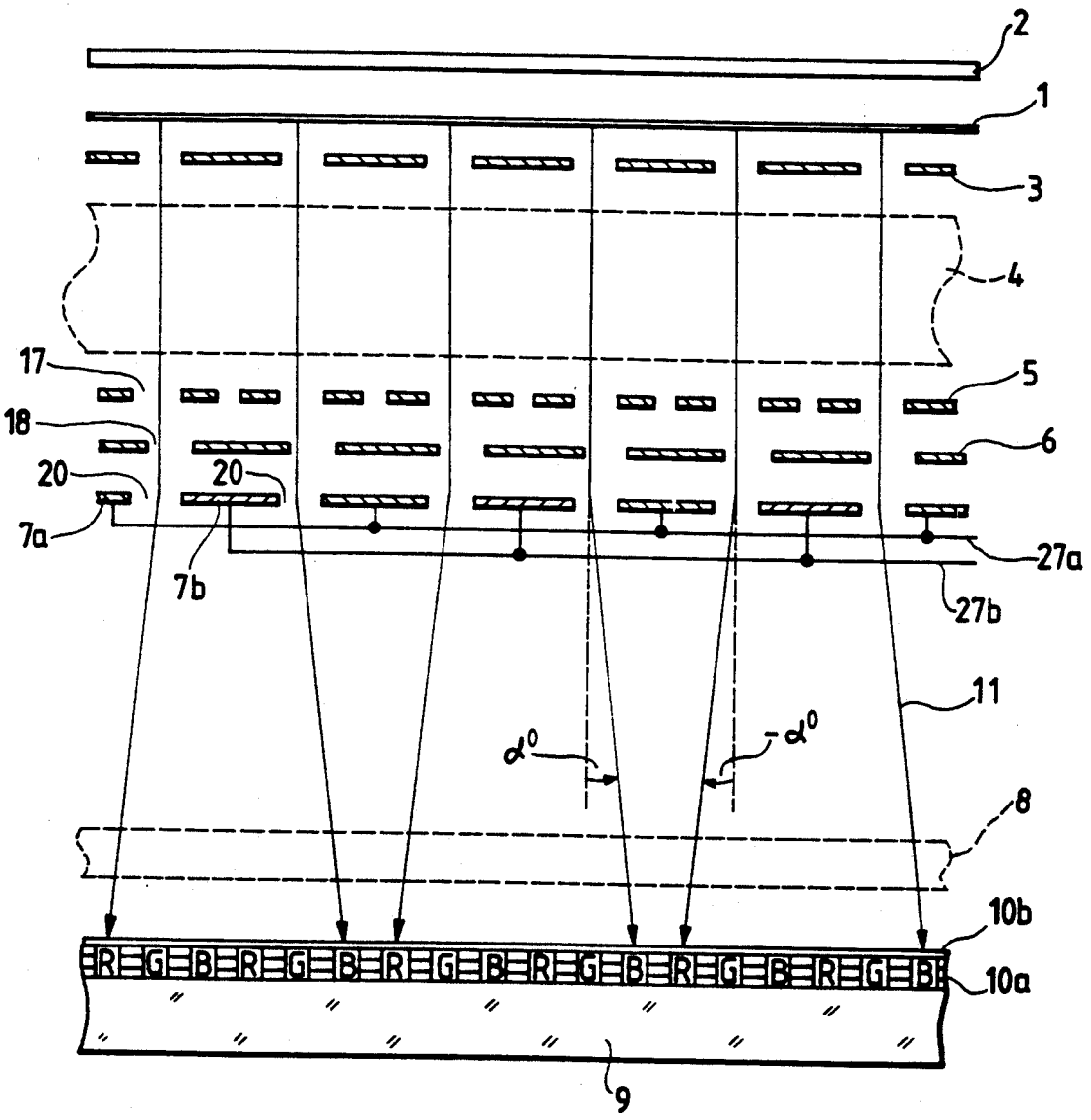
FIG. 7 is a plan cross-sectional view of a second embodiment of a flat configuration image display apparatus according to the present invention.

A second embodiment of the invention will now be described, referring to the plan cross-sectional view of FIG. 7. With the first embodiment described above, the configuration of the horizontal deflection electrodes is such that the horizontal deflection directions of all of the electron beams are mutually identical. This is achieved by utilizing (for electron beam transfer therethrough) only one half of the total number of vertically elongated apertures that are defined between the mutually intermeshed electrodes *7a, 7b*. With the second embodiment on the other hand, all of these vertically elongated apertures are made of identical width and all of them are utilized as respective electron beam transfer apertures 20, as shown in FIG. 7. As a result, defining an angle of (horizontal) deflection that is produced in one of the apertures 20 of the horizontal deflection electrodes *7a, 7b* as a result of a differential deflection voltage applied therebetween as $\alpha°$, then the angle of deflection that is produced in each of the immediately adjacent apertures 20 will be $-\alpha°$ (i.e. $360°-\alpha°$). However in spite of this opposite direction of deflection produced between successively adjacent ones of the apertures 20 of the horizontal deflection electrodes *7a, 7b*, the beam landing position correction that has been described for the first embodiment of the invention can be achieved in exactly the same way as described for the first embodiment, i.e. by horizontal position displacement of the central axis of each of the apertures 18 of the shield electrode 6 with respect to the respective corresponding central axes of the apertures 20 and 17 of the electrodes *7a, 7b* and the modulation electrodes 5. That is to say, for any specific level of trajectory correction voltage being applied to the shield electrode 6, an identical amount of beam landing position shift will be applied to all of the electron beams 11. The voltage drive circuit for the shield electrode 6 can be identical to that of the first embodiment. Thus it can be understood that the simplicity of the present invention is retained in the case of this second embodiment.

The second embodiment has the advantage that the separation pitch of the "teeth" of the comb-shaped horizontal deflection electrodes *7a, 7b* can be made twice that of the first embodiment, so that the mechanical strength of these electrodes can be increased, and hence the manufacturing process is facilitated.

With the embodiments described above, each through-aperture 18 of the shield electrode 6 has a central axis that is horizontally displaced with respect to the corresponding aperture central axis of the horizontal deflection electrodes *7a, 7b*. However it would be equally possible to provide an electrode which is used only for electron beam trajectory correction, and is separate from the shield electrode 6, with respective vertically elongated apertures provided in that correction electrode which are horizontally displaced with respect to corresponding apertures in the horizontal deflection electrodes etc. Such a separate electron beam trajectory correction electrode could be positioned at the rear of the horizontal deflection electrodes *7a, 7b* (i.e. between those electrodes and the shield electrode 6) or in front of the electrodes *7a, 7b* (i.e. between those electrodes and the faceplate). By applying an electron beam trajectory correction voltage to such an electrode, similar results to those described above could be obtained.

Furthermore, instead of displacing the central axes of the apertures in an electrode that is positioned before or after the horizontal deflection electrodes *7a, 7b* as described in the above, it would be possible to instead horizontally displace the central axis of each of the apertures 20 of the horizontal deflection electrodes *7a, 7b* with respect to the central axes of the corresponding apertures of the other electrodes (i.e. the shield electrode 6 etc). In that case, the trajectory correction voltage would be applied to each of the electrodes *7a, 7b*, superimposed on the horizontal scanning voltages which are applied thereto.

In the description of the trajectory correction voltage signal generating circuit of FIG. 6A, it is assumed that the trajectory correction voltage is altered once in each horizontal scanning interval. However it should be noted that if the amount of position error between the electrode structure and the fluorescent layer pattern of the CRT is very small, then it may be possible to alter the trajectory correction voltage once in every two horizontal scanning intervals.

It will also be apparent that various other changes and modifications could be envisaged which fall within the basic technical concepts of the present invention.

With a flat configuration CRT according to the present invention as described in the above, a predetermined amount of separation is established between the central axis of each of a plurality of vertically elongated beam deflection apertures defined by horizontal deflection electrodes and the central axis of each corresponding apertures formed in at least one other electrode which is positioned either before or after the horizontal scanning electrodes with respect to a direction of electron beam advancement. As a result, by applying a periodically varying electron beam trajectory correction voltage to the horizontal deflection electrode or to the aforementioned other electrode, it becomes possible to correct for a positioning error whereby the horizontal deflection electrode is axially rotated by a certain amount of angular error with respect to a fluorescent layer pattern of the faceplate of the CRT. Hence, a color deviation between upper and lower portions of the display can be eliminated. Thus, the manufacturing yield of such a CRT can be substantially increased.

What is claimed is:

1. In a flat configuration cathode ray tube comprising an electron beam source for producing at least one row of electron beams, a fluorescent material layer formed in a predetermined pattern on a surface of a transparent plate, and a plurality of electrode means successively disposed between said electron beam source and said fluorescent material layer, said plurality of electrode means comprising horizontal deflection electrode means defining a first plurality of vertically extending apertures for passing respective ones of said electrode beams, and at least one other electrode means, located upstream from said horizontal deflection electrode means and defining a second plurality of vertically extending apertures for passing said respective electron beams, the improvement wherein:

a central axis of each of said first plurality of vertically extending apertures of the horizontal deflection electrode means and a central axis of a corresponding one of said second plurality of vertically extending apertures of said at least one other electrode means being mutually separated by a predetermined distance, and further comprising trajectory correction voltage generating means for supplying to said at least one other electrode means a trajectory correction voltage which varies in amplitude during each vertical scanning interval, for dynamically correcting respective beam landing positions of said electron beams during said each vertical scanning interval.

2. A flat configuration cathode ray tube according to claim 1, in which said at least one other electrode means comprises shield electrode means positioned immediately adjacent to said horizontal deflection electrode means.

3. In a flat configuration cathode ray tube comprising an electron beam source for producing at least one row of electron beams, and a fluorescent material layer formed in a predetermined pattern on a surface of a transparent plate, and a plurality of electrode means successively disposed between said electron beam source and said fluorescent material layer, said plurality of electrode means comprising horizontal deflection electrode means defining a first plurality of vertically extending apertures for passing respective ones of said electron beams and at least one other electrode means, located upstream from said horizontal deflection electrode means and defining a second plurality of vertically extending apertures for passing said respective electron beams, the improvement wherein:

each of said first plurality of vertically extending apertures of the horizontal deflection electrode means has a central axis which is horizontally displaced by a predetermined distance from a central axis of a corresponding one of said second plurality of vertically extending apertures of said at least one other electrode means, and further comprising trajectory correction voltage generating means for supplying to said horizontal deflection electrode means a trajectory correction voltage which varies in amplitude during each successive vertical scanning interval such as to produce correction of respective beam landing positions of said electron beams.

4. A flat configuration cathode ray tube according to claim 3, in which said at least one other electrode means comprises shield electrode means positioned immediately adjacent to said horizontal deflection electrode means.

5. In a flat configuration cathode ray tube comprising an electron beam source for producing at least one row of electron beams, a fluorescent material layer formed in a predetermined pattern on a surface of a transparent plate, and a plurality of electrode means successively disposed between said electron beam source and said fluorescent material layer, said plurality of electrode means defining a first plurality of vertically extending apertures for passing respective ones of said electron beams and at least one other electrode means, located upstream from said horizontal deflection electrode means and defining a second plurality of vertically extending apertures for passing said respective electron beams, the improvement wherein:

each of said first plurality of vertically extending apertures of the horizontal deflection electrode means has a central axis which is horizontally displaced by a predetermined distance from a central axis of a corresponding one of said second plurality of vertically extending apertures of said at least one other electrode means, and further comprising trajectory correction voltage generating means for supplying to said horizontal deflection electrode means a trajectory correction voltage which varies in amplitude during each vertical scanning interval, for dynamically correcting respective beam landing positions of said electron beam during said each vertical scanning interval.

* * * * *